US006596677B1

(12) United States Patent
Machac, Jr. et al.

(10) Patent No.: US 6,596,677 B1
(45) Date of Patent: Jul. 22, 2003

(54) PROPYLENE CARBONATE BASED CLEANING COMPOSITIONS

(75) Inventors: James R. Machac, Jr., Lago Vista, TX (US); Susan A. Woodrum, Round Rock, TX (US); Howard P. Klein, Austin, TX (US); Edward T. Marquis, Austin, TX (US)

(73) Assignee: Huntsman Petrochemical Corporation, Austin, TX (US)

( * ) Notice: Subject to any disclaimer, the term of this patent is extended or adjusted under 35 U.S.C. 154(b) by 95 days.

(21) Appl. No.: 09/668,961

(22) Filed: Sep. 25, 2000

(51) Int. Cl.[7] ..... C11D 17/00

(52) U.S. Cl. ..... 510/238; 510/240; 510/506; 510/509; 510/189; 510/214; 134/40; 134/41

(58) Field of Search ..... 510/201, 206, 510/240, 203, 506, 188, 509, 174, 238, 189; 134/40, 41, 42, 34

(56) References Cited

U.S. PATENT DOCUMENTS

| | | | | |
|---|---|---|---|---|
| 4,645,617 A | | 2/1987 | Vivian | 252/165 |
| 5,179,214 A | | 1/1993 | Marquis et al. | 549/230 |
| 5,817,612 A | | 10/1998 | Distaso | 510/203 |
| 5,821,209 A | | 10/1998 | Distaso et al. | 510/207 |
| 6,017,872 A | | 1/2000 | Pedersen et al. | 510/424 |
| 6,187,108 B1 | * | 2/2001 | Machac, Jr. et al. | 134/38 |

FOREIGN PATENT DOCUMENTS

| | | | |
|---|---|---|---|
| EP | 0 316 726 | 5/1989 | 17/18 |
| EP | 0 611 214 | 8/1994 | 7/50 |
| WO | 98/53016 | 11/1998 | |

* cited by examiner

*Primary Examiner*—Necholus Ogden
(74) *Attorney, Agent, or Firm*—Gardere Wynne Sewell LLP

(57) ABSTRACT

Propylene carbonate based cleaning compositions. The compositions comprise propylene carbonate, a glycol ether, water, and an acid activator. The compositions may optionally also comprise hydrogen peroxide. The present invention also provides for a method of removing a soil from a hard surface, wherein a cleaning composition comprising propylene carbonate, a glycol ether, water, and an acid activator is applied to the hard surface. After application of the cleaning composition, the soil is removed from the hard surface without the exertion of mechanical force.

32 Claims, No Drawings

PROPYLENE CARBONATE BASED CLEANING COMPOSITIONS

TECHNICAL FIELD

This invention relates to cleaning compositions, and, more particularly, to propylene carbonate based cleaning compositions, and a method of use for such cleaning compositions.

BACKGROUND OF THE INVENTION

The cleaning of hard surfaces such as, but not limited to, tiles, counter tops, fixtures, faucets, sinks, bath tubs, shower stalls, metallic car bumpers and wheels is a labor intensive activity. Typically, in cleaning such surfaces, an aqueous cleaner composition is applied to the soiled surface either in a foamed or non-foamed aqueous composition. The soil is then mechanically contacted with scrub brushes, cleaning towels, and/or other cleaning implements. Then, the soil and the cleaning composition are rinsed off the surface, and the surface is dried by wiping or other suitable process.

Due to the labor intensive nature of cleaning such hard surfaces, any reduction in the time, energy, and materials used to clean such hard surfaces would be a substantial benefit. Accordingly, a substantial need exists for improved cleaning compositions that require only the application of the composition, and no subsequent scrubbing, rubbing, rinsing, or drying.

SUMMARY OF THE INVENTION

Accordingly, in one embodiment, the present invention is directed toward propylene carbonate based cleaning compositions. The compositions comprise propylene carbonate, a glycol ether, water, and an acid activator. The compositions may optionally also comprise hydrogen peroxide. The compositions of the present invention are effective without scrubbing, rubbing, or the like. In addition, the compositions of the present invention need not be rinsed or wiped off the surface after application. In essence, the method of the present invention is a one step, non-labor intensive method.

In another embodiment, the present invention provides for a method of removing a soil from a hard surface. In this embodiment, a cleaning composition comprising propylene carbonate, a glycol ether, water, and an acid activator is applied to the hard surface. After application of the cleaning composition, the soil is removed from the hard surface without the exertion of mechanical force.

DETAILED DESCRIPTION OF THE PREFERRED EMBODIMENT

Propylene carbonate is an excellent solvent for many organic and inorganic materials, and, as such, is used in a variety of applications and compositions, including, but not limited to, cleaners, degreasers, dyes, fibers, plastics, batteries, as a gellant for clays, and as a curing agent/accelerator for foundry sand resins. Because propylene carbonate has a low toxicity and it is virtually odorless, it is suitable for use in applications that involve human contact. These facts, coupled with its ability to remove stains, makes propylene carbonate an outstanding candidate for use in household and industrial cleaning products.

Accordingly, the present invention provides for propylene carbonate based cleaning compositions. The compositions comprise propylene carbonate, a glycol ether, water, and an acid activator. The compositions may optionally also comprise hydrogen peroxide. The addition of hydrogen peroxide is thought to improve the bleaching and cleansing activity of the composition, as well as its disinfectancy.

The compositions of the present invention may be prepared by blending or mixing the components of the composition according to any method known in the art. Preferably, the compositions of the present invention comprise at least about 2% propylene carbonate, at least about 2% glycol ether, at least about 50% water, and less than about 5% of an acid activator. More preferably, the compositions of the present invention comprise from about 2% to about 25% propylene carbonate, from about 2% to about 25% glycol ether, and less than about 95% water. The compositions may optionally comprise up to about 10% hydrogen peroxide.

The acid activator may comprise any number of acid activators. As used herein "acid activator" means an acidic substance that increases the efficacy of the formulation. Preferably, the acid activator is selected from the group consisting of citric acid, maleic anhydride, and maleic acid.

The glycol ether may comprise any number of glycol ethers. Preferably, the glycol ether comprises a propylene glycol-based ether, such as, but not limited to, propylene glycol ethyl ether, propylene glycol n-propyl ether, propylene glycol isopropyl ether, or propylene glycol n-butyl ether. More preferably, the glycol ether comprises propylene glycol mono-methyl ether.

The compositions of the present invention may be used on any number of hard surfaces. Such hard surfaces may include, but are not limited to, tiles, counter tops, fixtures, faucets, sinks, bath tubs, shower stalls, metallic car bumpers and wheels, etc.

The compositions of the present invention may be used to remove a variety of soils from any number of hard surfaces. Presumably, the compositions of the present invention may be used to remove a variety of dry or oily dirts from a hard surface. Without limitation, the compositions of the present invention are particularly suited at removing soap scum and mildew from hard surfaces.

Soap scum, which contains water insoluble calcium and magnesium soaps, is produced by the reaction between hard water and soluble sodium soaps. Soap scum causes dulling and streaking of the surfaces that it contacts, which most commonly includes bathroom surfaces, such as sinks, counter tops, tubs, shower walls and floors, and ceramic tile walls and floors. Because soap scum usually adheres strongly to surfaces, it is difficult to remove without the aid of a cleaning composition.

The present invention also provides for a method of removing a soil from a hard surface. The method involves applying a cleaning composition comprising propylene carbonate, a glycol ether, water, and an acid activator to the soil on the hard surface. Preferably, the composition comprises at least about 2% propylene carbonate, at least about 2% glycol ether, at least about 50% water, and less than about 5% of an acid activator. More preferably, the compositions of the present invention comprise from about 2% to about 25% propylene carbonate, from about 2% to about 25% glycol ether, and less than about 95% water. The compositions may optionally comprise up to about 10% hydrogen peroxide. After application, the soil is removed from the hard surface without the use of any mechanical force.

In the method of the present invention, the composition may be applied to the hard surface to be cleaned by any number of methods, including, but not limited to, spraying, dipping, painting, wiping, etc. The cleaning compositions of the present invention, without a thickener, are of about the viscosity of water, and, as such, are preferably applied to surfaces as fine sprays to avoid excessive dripping of the composition.

In the method of the present invention, after application of the composition to the soiled surface, no mechanical force needs to be exerted to enhance the effectiveness of the composition. The compositions of the present invention are effective without scrubbing, rubbing, or the like. In addition, the compositions of the present invention need not be rinsed or wiped off the surface after application. Advantageously, the compositions of the present invention require only application of the composition, and no subsequent scrubbing, rubbing, or rinsing. In essence, the method of the present invention is a one step, non-labor intensive method.

The following examples are illustrative of the present invention, and are not intended to limit the scope of the invention in any way.

EXAMPLE 1

Preparation of the Cleaning Compositions

The cleaning compositions were blended as follows (in grams):

| Sample | PC/PM[1] | $H_2O$ | PA[2] | Citric Acid | Maleic Acid | Maleic Anhydride | 35% $H_2O_2$ |
|---|---|---|---|---|---|---|---|
| 1 | 198 | 198 | 4 | | | | |
| 2 | 198 | 198 | | 4 | | | |
| 3 | 196 | 196 | | 12 | | | |
| 4 | 194 | 194 | | 20 | | | |
| 5 | 198 | 198 | | | 4 | | |
| 6 | 196 | 196 | | | 12 | | |
| 7 | 194 | 194 | | | 20 | | |
| 8 | 198 | 198 | | | | 4 | |
| 9 | 196 | 196 | | | | 12 | |
| 10 | 194 | 194 | | | | 20 | |
| 11 | 58.9 | 187.5 | | 3.6 | | | |
| 12 | 56.7 | 187.5 | | 5.8 | | | |
| 13 | 73.5 | 187.5 | | | 1.5 | | |
| 14 | 58.9 | 187.5 | | | 3.6 | | |
| 15 | 61.3 | 187.5 | | | 1.2 | | |
| 16 | 58.9 | 187.5 | | | | 3.6 | |
| 17 | 56.7 | 187.5 | | | | 5.8 | |
| 18 | 25 | 225 | | 1.4 | | | |
| 19 | 25 | 225 | | 2.3 | | | |
| 20 | 25 | 225 | | | 0.5 | | |
| 21 | 25 | 225 | | | 1.4 | | |
| 22 | 25 | 225 | | | | 0.5 | |
| 23 | 25 | 225 | | | | 1.4 | |
| 24 | 25 | 225 | | | | 2.3 | |
| 25 | 11.8 | 237.5 | | 0.66 | | | |
| 26 | 11.4 | 237.5 | | 1.05 | | | |
| 27 | 12.3 | 237.5 | | | 0.2 | | |

-continued

| Sample | PC/PM[1] | $H_2O$ | PA[2] | Citric Acid | Maleic Acid | Maleic Anhydride | 35% $H_2O_2$ |
|---|---|---|---|---|---|---|---|
| 28 | 11.8 | 237.5 | | | 0.66 | | |
| 29 | 12.3 | 237.5 | | | | 0.2 | |
| 30 | 11.8 | 237.5 | | | | 0.66 | |
| 31 | 11.4 | 237.5 | | | | 1.05 | |
| 32 | 10 | 232.9 | | | | | 7.1 |
| 33 | 9.8 | 232.9 | | 0.2 | | | 7.1 |

[1]50% propylene carbonate and 50% propylene glycol mono-methyl ether
[2]polyaspartic acid (purchased from Aldrich Chemical Co.)

EXAMPLE 2

Preparation of Tiles and Testing

Black ceramic tiles were cleaned with soap and water, and rinsed with methanol. The reflectance/gloss of the cleaned tiles was measured at 20° C. and 60° C. using a Garnder micro glass meter. After the reflectance/gloss of the cleaned tiles was measured, the tiles were sprayed with a soap scum soil composition, which comprised the following:

| Ingredient | Amount (grams) |
|---|---|
| Hard Water (containing 500 ppm $CaCl_2$) | 97.25 |
| IVORY ® soap bar | 0.5 |
| Isopropyl alcohol | 2.0 |
| Calcium Chloride | 0.25 |

The sprayed tiles were then baked in an oven at a temperature of 60° C. for one hour. After baking, the tiles were then sprayed with the sample solutions prepared in Example 1 and two commercially available cleaners (Shower Shine by Scrubbing Bubbles (made by SC Johnson) and Scrub Free Daily Shower Cleaner (distributed by Banckiser)), and the reflectance/gloss of the tiles was measured at 20° C. and 60° C.

The reflectance/gloss measurements were used to evaluate the ability of each sample solution to clean the tiles. Specifically, gloss retention was calculated according to the following formula:

$$\text{gloss retention } (\Delta G)(\%)=(G_a/G_o)*100\%$$

where $G_a$ is the gloss of the tiles after application of the sample solution, and $G_o$ is the gloss of the clean tiles prior to application of the soap scum composition.

The results of the testing are summarized in Table 1:

TABLE 1

| | $G_o$ | | $G_a$ | | ΔG (%) | | Average ΔG (%) | |
|---|---|---|---|---|---|---|---|---|
| Sample | 20° C. | 60° C. | 20° C. | 60° C. | 20° C. | 60° C. | 20° C. | 60° C. |
| 1 | 72 | 88 | 40 | 55 | 55.6 | 62.5 | 57.38 | 65.69 |
| | 76 | 90 | 45 | 62 | 59.2 | 68.9 | | |
| 2 | 75 | 90 | 42 | 62 | 56.0 | 68.9 | 60.14 | 74.22 |
| | 70 | 88 | 45 | 70 | 64.3 | 79.5 | | |
| 3 | 70 | 89 | 44 | 65 | 62.9 | 73.0 | 69.62 | 76.29 |
| | 72 | 88 | 55 | 70 | 76.4 | 79.5 | | |

TABLE 1-continued

| | $G_o$ | | $G_a$ | | ΔG (%) | | Average ΔG (%) | |
|---|---|---|---|---|---|---|---|---|
| Sample | 20° C. | 60° C. | 20° C. | 60° C. | 20° C. | 60° C. | 20° C. | 60° C. |
| 4 | 76 | 90 | 50 | 65 | 65.8 | 72.2 | 68.61 | 72.16 |
| | 70 | 86 | 50 | 62 | 71.4 | 72.1 | | |
| 5 | 76 | 90 | 70 | 85 | 92.1 | 94.4 | 85.53 | 91.18 |
| | 75 | 91 | 60 | 80 | 78.9 | 87.9 | | |
| 6 | 76 | 91 | 45 | 60 | 59.2 | 65.9 | 68.27 | 69.23 |
| | 75 | 91 | 58 | 66 | 77.3 | 72.5 | | |
| 7 | 77 | 92 | 50 | 68 | 64.9 | 73.9 | 58.11 | 71.05 |
| | 78 | 88 | 40 | 60 | 51.3 | 68.2 | | |
| 8 | 68 | 88 | 65 | 85 | 95.6 | 96.6 | 93.25 | 94.03 |
| | 66 | 82 | 60 | 75 | 90.9 | 91.5 | | |
| 9 | 70 | 90 | 55 | 75 | 78.6 | 83.3 | 79.29 | 82.88 |
| | 75 | 91 | 60 | 75 | 80.0 | 82.4 | | |
| 10 | 70 | 88 | 40 | 65 | 57.1 | 73.9 | 66.24 | 79.07 |
| | 73 | 89 | 55 | 75 | 75.3 | 84.3 | | |
| 11 | 75 | 90 | 65 | 80 | 86.7 | 88.9 | 84.6 | 87.7 |
| | 74 | 90 | 60 | 75 | 81.1 | 83.3 | | |
| | 72 | 88 | 62 | 80 | 86.1 | 90.9 | | |
| 12 | 70 | 87 | 60 | 75 | 85.7 | 86.2 | 91.3 | 90.3 |
| | 78 | 92 | 75 | 85 | 96.2 | 92.4 | | |
| | 76 | 92 | 70 | 85 | 92.1 | 92.4 | | |
| 13 | 76 | 90 | 70 | 86 | 92.1 | 95.6 | 94.3 | 95.2 |
| | 77 | 92 | 75 | 88 | 97.4 | 95.7 | | |
| | 75 | 90 | 70 | 85 | 93.3 | 84.4 | | |
| 14 | 76 | 90 | 72 | 85 | 94.7 | 94.4 | 90.8 | 80.9 |
| | 76 | 92 | 65 | 78 | 85.5 | 84.8 | | |
| | 76 | 91 | 70 | 85 | 92.1 | 93.4 | | |
| 15 | 72 | 88 | 72 | 88 | 100 | 100 | 95.2 | 96.4 |
| | 76 | 92 | 72 | 88 | 94.7 | 95.7 | | |
| | 77 | 92 | 70 | 86 | 90.9 | 93.5 | | |
| 16 | 76 | 92 | 70 | 85 | 92.1 | 92.4 | 92.0 | 90.9 |
| | 72 | 90 | 65 | 78 | 90.3 | 86.7 | | |
| | 77 | 92 | 72 | 86 | 93.5 | 93.5 | | |
| 17 | 77 | 92 | 71 | 85 | 92.2 | 92.4 | 89.5 | 89.0 |
| | 76 | 91 | 65 | 80 | 85.5 | 87.9 | | |
| | 75 | 90 | 68 | 78 | 90.7 | 86.7 | | |
| 18 | 72 | 88 | 68 | 86 | 94.4 | 97.7 | 96.0 | 98.14 |
| | 76 | 91 | 72 | 90 | 94.7 | 98.9 | | |
| | 75 | 90 | 74 | 88 | 98.7 | 97.8 | | |
| 19 | 70 | 88 | 62 | 80 | 88.6 | 90.9 | 91.4 | 92.5 |
| | 73 | 90 | 70 | 80 | 85.9 | 88.9 | | |
| | 78 | 90 | 70 | 88 | 89.7 | 97.8 | | |
| 20 | 72 | 88 | 68 | 86 | 94.4 | 97.7 | 97.3 | 97.8 |
| | 70 | 90 | 70 | 88 | 100 | 97.8 | | |
| | 78 | 92 | 76 | 90 | 97.4 | 97.8 | | |
| 21 | 72 | 88 | 68 | 85 | 94.4 | 96.6 | 94.5 | 97.0 |
| | 72 | 90 | 68 | 88 | 94.4 | 97.8 | | |
| | 76 | 91 | 72 | 88 | 94.7 | 96.7 | | |
| 22 | 76 | 90 | 70 | 88 | 92.1 | 97.8 | 94.8 | 97.8 |
| | 76 | 90 | 74 | 88 | 97.4 | 97.8 | | |
| | 77 | 92 | 73 | 90 | 94.8 | 97.8 | | |
| 23 | 78 | 92 | 70 | 85 | 89.7 | 92.4 | 91.5 | 95.3 |
| | 76 | 90 | 72 | 88 | 94.7 | 97.8 | | |
| | 80 | 94 | 72 | 90 | 90.0 | 95.7 | | |
| 24 | 76 | 91 | 68 | 86 | 89.5 | 94.5 | 92.1 | 95.2 |
| | 74 | 90 | 70 | 82 | 94.6 | 91.1 | | |
| | 78 | 90 | 72 | 90 | 92.3 | 100 | | |
| 25 | 80 | 93 | 75 | 90 | 93.8 | 96.8 | 93.6 | 94.91 |
| | 78 | 92 | 74 | 88 | 94.9 | 95.7 | | |
| | 76 | 91 | 70 | 84 | 92.1 | 92.3 | | |
| 26 | 76 | 90 | 70 | 85 | 92.1 | 94.4 | 93.4 | 95.2 |
| | 74 | 90 | 68 | 88 | 91.9 | 94.4 | | |
| | 77 | 91 | 74 | 85 | 96.1 | 96.7 | | |
| 27 | 78 | 92 | 73 | 85 | 93.6 | 92.4 | 96.1 | 95.3 |
| | 78 | 92 | 75 | 90 | 96.2 | 97.8 | | |
| | 75 | 90 | 74 | 86 | 98.7 | 95.6 | | |
| 28 | 77 | 90 | 74 | 88 | 96.1 | 97.8 | 94.3 | 95.2 |
| | 78 | 91 | 72 | 86 | 92.3 | 94.5 | | |
| | 72 | 91 | 68 | 85 | 94.4 | 93.4 | | |
| 29 | 74 | 91 | 72 | 88 | 97.3 | 96.7 | 94.7 | 96.3 |
| | 76 | 91 | 71 | 88 | 93.4 | 96.7 | | |
| | 75 | 90 | 70 | 86 | 93.3 | 95.6 | | |
| 30 | 75 | 90 | 70 | 87 | 93.3 | 96.7 | 95.1 | 97.4 |
| | 76 | 90 | 72 | 88 | 94.7 | 97.8 | | |
| | 72 | 88 | 70 | 86 | 97.2 | 97.7 | | |
| 31 | 80 | 92 | 75 | 88 | 93.8 | 95.7 | 94.4 | 96.4 |

TABLE 1-continued

| | $G_o$ | | $G_a$ | | ΔG (%) | | Average ΔG (%) | |
|---|---|---|---|---|---|---|---|---|
| Sample | 20° C. | 60° C. | 20° C. | 60° C. | 20° C. | 60° C. | 20° C. | 60° C. |
| | 72 | 87 | 68 | 85 | 94.4 | 97.7 | | |
| | 75 | 89 | 72 | 86 | 96.0 | 96.6 | | |
| 32 | 6 | 90 | 70 | 88 | 92.1 | 97.8 | 90.3 | 91.1 |
| | 72 | 88 | 70 | 86 | 97.2 | 97.7 | | |
| | 76 | 90 | 72 | 86 | 94.7 | 95.6 | | |
| 33 | 73 | 90 | 70 | 84 | 95.9 | 93.3 | 86.9 | 91.1 |
| | 74 | 90 | 72 | 88 | 97.3 | 97.8 | | |
| | 76 | 92 | 70 | 88 | 92.1 | 95.7 | | |
| Shower | 75 | 91 | 55 | 70 | 73.3 | 76.9 | 83.5 | 86.9 |
| Shine | 68 | 86 | 50 | 65 | 73.5 | 75.6 | | |
| | 76 | 91 | 62 | 78 | 81.6 | 85.7 | | |
| | 78 | 91 | 65 | 76 | 83.3 | 83.5 | | |
| | 76 | 90 | 60 | 78 | 78.9 | 86.7 | | |
| | 70 | 88 | 60 | 80 | 85.7 | 90.9 | | |
| | 73 | 90 | 63 | 82 | 86.3 | 91.1 | | |
| | 76 | 90 | 68 | 86 | 89.5 | 95.6 | | |
| | 78 | 93 | 68 | 88 | 87.2 | 94.6 | | |
| | 74 | 90 | 66 | 80 | 89.2 | 88.9 | | |
| | 76 | 90 | 68 | 78 | 89.5 | 86.7 | | |
| Scrub | 78 | 92 | 60 | 75 | 76.9 | 81.5 | 82.4 | 88.6 |
| Free | 74 | 90 | 58 | 78 | 78.4 | 86.7 | | |
| | 76 | 92 | 60 | 84 | 78.9 | 91.3 | | |
| | 77 | 91 | 60 | 85 | 77.9 | 93.4 | | |
| | 74 | 93 | 60 | 82 | 81.1 | 88.2 | | |
| | 72 | 90 | 60 | 72 | 83.3 | 90.0 | | |
| | 75 | 90 | 60 | 78 | 90.0 | 86.7 | | |
| | 76 | 91 | 68 | 86 | 89.5 | 94.5 | | |
| | 80 | 93 | 68 | 80 | 85.0 | 86.0 | | |
| | 76 | 92 | 62 | 82 | 81.6 | 89.1 | | |
| | 72 | 90 | 60 | 78 | 83.3 | 86.7 | | |

Table 1 shows that the majority of the tested samples outperformed the commercially available cleaners.

EXAMPLE 3

Prophetic

The compositions prepared in Example 1 are used to clean a variety of dry and oily dirts, including soap scum and mildew, off counter tops, fixtures, faucets, sinks, bath tubs, shower stalls, and metallic car bumpers and wheels. After application with the composition, the dirts are removed from each surface without the exertion of mechanical force.

Although illustrative embodiments have been shown and described, a wide range of modification, changes, and substitution is contemplated in the foregoing disclosure. In some instances, some features of the disclosed embodiments may be employed without a corresponding use of the other features. Accordingly, it is appropriate that the appended claims be construed broadly and in a manner consistent with the scope of the invention.

What is claimed is:

1. A cleaning composition comprising:

a. propylene carbonate;

b. a glycol ether;

c. water;

d. an acid activator; and e. hydrogen peroxide.

2. The composition of claim 1, wherein the acid activator is selected from the group consisting of citric acid, maleic anhydride, and maleic acid.

3. The composition of claim 1, wherein the composition comprises at least about 2% propylene carbonate.

4. The composition of claim 1, wherein the composition comprises at least about 2% of the glycol ether.

5. The composition of claim 1, wherein the composition comprises at least about 50% water.

6. The composition of claim 1, wherein the glycol ether comprises propylene glycol mono-methyl ether.

7. The composition of claim 1, wherein the composition comprises up to about 10% hydrogen peroxide.

8. A hard surface cleaning composition comprising:

a. propylene carbonate;

b. a glycol ether;

c. water;

d. an acid activator; and e. hydrogen peroxide.

9. The composition of claim 8, wherein the acid activator is selected from the group consisting of citric acid, maleic anhydride, and maleic acid.

10. The composition of claim 8, wherein the composition comprises at least about 2% propylene carbonate.

11. The composition of claim 8, wherein the composition comprises at least about 2% of the glycol ether.

12. The composition of claim 8, wherein the composition comprises at least about 50% water.

13. The composition of claim 8, wherein the glycol ether comprises propylene glycol mono-methyl ether.

14. The composition of claim 8, wherein the composition comprises up to about 10% hydrogen peroxide.

15. The composition of claim 8, wherein the hard surface is a bathtub.

16. The composition of claim 8, wherein the hard surface is tile.

17. A hard surface cleaning composition comprising:

a. at least 2% propylene carbonate;

b. at least 2% of a glycol ether;

c. at least 50% water;

d. less than about 5% of an acid activator; and e. hydrogen peroxide.

18. The composition of claim 17, wherein the acid activator is selected from the group consisting of citric acid, maleic anhydride, and maleic acid.

19. The composition of claim 17, wherein the glycol ether comprises propylene glycol mono-methyl ether.

20. The composition of claim 17, wherein the composition contains up to about 10% hydrogen peroxide.

21. The composition of claim 17, wherein the hard surface is a bathtub.

22. The composition of claim 17, wherein the hard surface is tile.

23. The method of claim 26, wherein the soil is soap scum.

24. The method of claim 26, wherein the hard surface is a bathtub.

25. The method of claim 26, wherein the hard surface is tile.

26. A method of removing a soil from a hard surface, comprising the step of applying a cleaning composition to the soil on the hard surface, wherein the cleaning composition comprises:

a. propylene carbonate;

b. a glycol ether;

c. an acid activator; and d. hydrogen peroxide wherein after application, the soil is removed from the hard surface without the exertion of mechanical force.

27. The method of claim 26, wherein the composition comprises up to about 10% hydrogen peroxide.

28. The method of claim 26, wherein the acid activator is selected from the group consisting of citric acid, maleic anhydride, and maleic acid.

29. The method of claim 26, wherein the composition comprises at least about 2% propylene carbonate.

30. The method of claim 26, wherein the composition comprises at least about 2% of the glycol ether.

31. The method of claim 26, wherein the composition comprises at least about 50% water.

32. The method of claim 26, wherein the glycol ether comprises propylene glycol mono-methyl ether.

* * * * *